United States Patent [19]

Hamilton

[11] Patent Number: 5,010,589

[45] Date of Patent: Apr. 30, 1991

[54] CLOTHING WITH IMPROVED CAMOUFLAGE

[76] Inventor: Douglas N. Hamilton, 12211 Rainbow Ave., Anchorage, Ak. 99516

[21] Appl. No.: 301,148

[22] Filed: Jan. 25, 1989

[51] Int. Cl.[5] ..... A41D 13/00

[52] U.S. Cl. ..... 2/1; 2/94; 2/125; 428/194; 428/919; D2/184

[58] Field of Search ..... 2/94, 69, DIG. 6, 1, 2/244, 91, 125, 126, 271, 304, 305, 308, 311, 313, 318, 336; 428/115, 294, 919; D2/79, 80, 81, 184, 187, 189

[56] References Cited

U.S. PATENT DOCUMENTS

| | | | |
|---|---|---|---|
| D. 79,559 | 10/1929 | Lambert | D2/183 |
| D. 190,623 | 6/1961 | Baker | D2/184 |
| 2,888,682 | 6/1959 | Dubois . | |
| 2,962,726 | 12/1960 | Wehrli | 2/311 |
| 4,106,124 | 8/1978 | Green | 428/919 X |
| 4,517,230 | 5/1985 | Crawford . | |
| 4,792,471 | 12/1988 | Lee | 2/94 |

FOREIGN PATENT DOCUMENTS

| | | | |
|---|---|---|---|
| 2486369 | 11/1980 | France . | |
| 130398 | 1/1928 | Switzerland | 428/115 |

OTHER PUBLICATIONS

Woodward et al., Advertisement, 12/55.

*Primary Examiner*—Wm. Carter Reynolds
*Attorney, Agent, or Firm*—William D. Hall

[57] ABSTRACT

Clothing for hunters or soldiers, having the usual design for purposes of camouflage also has fringe, in the form of a multiplicity of closely spaced elongated elements, hanging below the sleeves. The fringe is removable. Scents or lures may be applied to the fringe. If it is desired to change from one scent or lure to another, several fringes may be provided each with a particular scent or lure. The scent or lure may, therefore, be easily changed by merely changing the fringe and without washing the garment.

11 Claims, 1 Drawing Sheet

CLOTHING WITH IMPROVED CAMOUFLAGE

BACKGROUND OF THE INVENTION

Hunters often wear camouflage clothing and sometimes apply scents and lures to the clothing. One problem with this procedure is that it is often difficult to change or remove the scent or lure.

Moreover, clothing that has designs that provide camouflage, still, when worn, have the shape of a human being.

The prior art teaches that various designs may be removably added to clothing, see, for example, French patent 2,486,369 dated Nov. 7, 1980. That patent teaches that a multiplicity of elongated elements may be attached to the bottom to a waistcoat of a child, allowing the child to make-believe that he or she is dressed differently.

SUMMARY OF THE INVENTION

The invention contemplates adding removable fringe, in the form of a multiplicity of elongated elements to clothing that has a camouflage design. The removable fringe may hang from various parts of the clothing but is especially effective if it hangs below the sleeves of a garment that covers at least the portion of the body above the waist of the wearer.

The fringe is removable and can, if desired, be repositioned on the clothing as desired to provide improved camouflage.

The removability of the fringe permits the wearer of the garment to apply scents or lures to the fringe rather than to the clothing itself. Thus, the scents or lures may be readily changed by substituting a different piece of removable fringe.

The fringe tends to break up the outline of the human body of the user and thus improves the comouflage of the wearer.

DETAILED DESCRIPTION OF THE INVENTION

Figure 1:
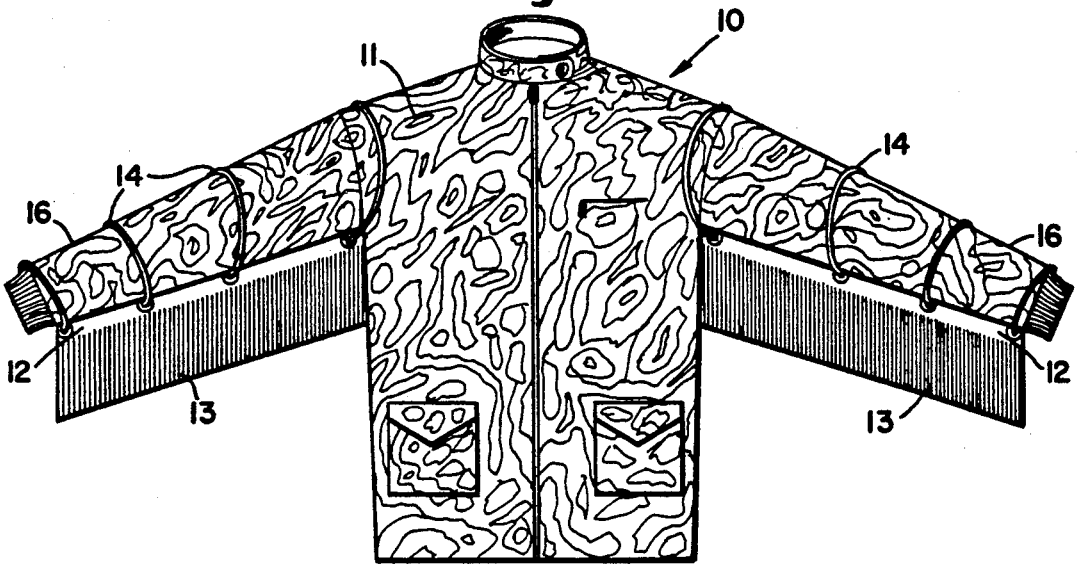
FIG. 1 is a front view of a coat embodying the invention.
Figure 2:
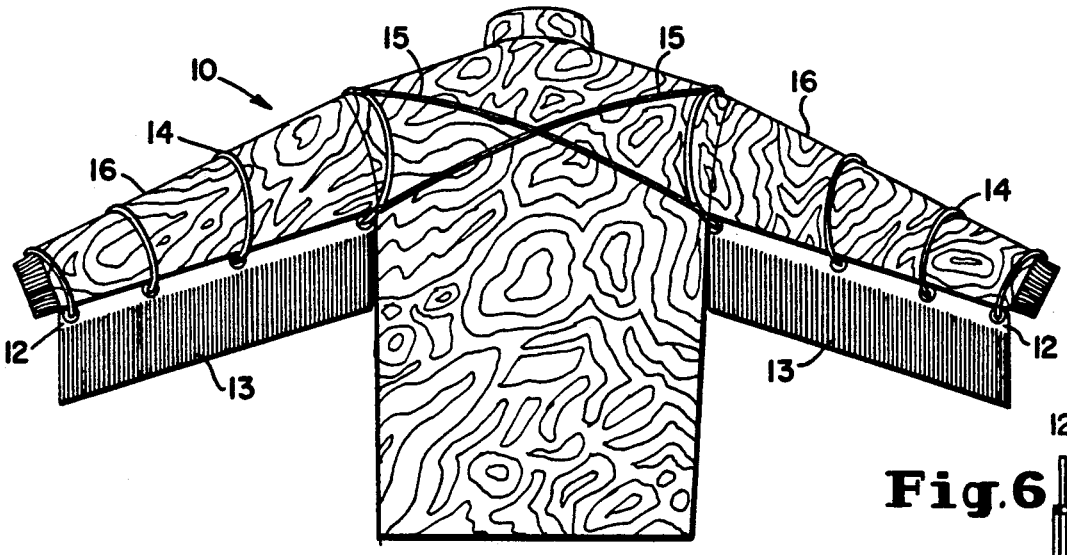
FIG. 2 is a rear view of the coat of FIG. 1.
Figure 6:
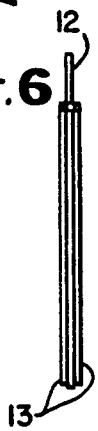
FIG. 6 is an end view of sheet 12, of FIG. 1, with fringe shown on both faces of the sheet.

FIG. 1 illustrates a coat 10, having a design 11 of the well known type of camouflage used by soldiers and hunters. The coat 10 has sleeves 16 encircled by elastic bands or rings 14 which hold a sheet 12 of cloth, leather, plastic or other material both sides of which are covered by fringe 13. The fringe 13 is preferably in the form of thin elongated pieces of cloth, nylon or other suitable material. The elongated pieces, which comprise fringe 13, hang freely from their top ends. The fringe covers both the front and rear faces of sheet 12. The elastic bands 14 on the left and right sleeves may be interconnected by elastic elements 15 to prevent the bands 14 from sliding down the sleeve.

Figure 3:
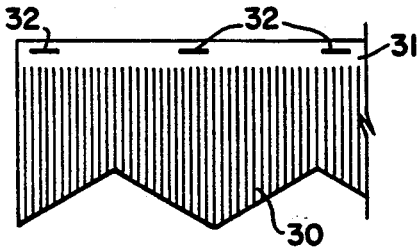
FIG. 3 shows a modified form of the removable fringe which is an element of the invention.

As shown in FIG. 3, the sheet of material 31 has fringe 30 on both of its faces. The sheet 31 may be attached to the clothing by velcro fasteners 32.

Figure 5:
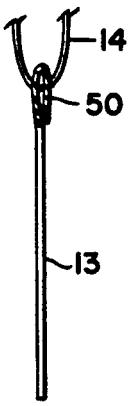
FIG. 5 is a side view of another modification in which a fringe element may be attached to the sleeve of a piece of clothing.
Figure 4:
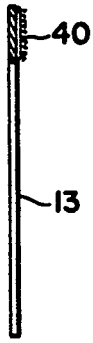
FIG. 4 is a side view of a single fringe element having velcro attachment means.

FIG. 4 shows a thin elongated fringe element 13 with a velcro fastener at its upper end for securing the element 13 to a supporting sheet such as sheets 12 or 31, or to the piece of clothing itself. As shown in FIG. 5, the thin elongated element 13 may also be held by a loop 50 that encircles ring or band 14 which surrounds a sleeve on a human arm. The modifications of FIGS. 4 and 5 contemplate a multiplicity of elongated elements 13, such as are shown in these two figures, hanging from a suitable portion of a garment, such as the sleeves, the neck, or the waist.

The fringe 13 cooperates with the camouflage design 11 to present an appearance that is different from the outline of a human being and thus gives improved camouflage effect.

Instead of applying scents or lures to their clothing, hunters may apply scents or lures to the above-described removable fringe. This has the advantage that it is unnecessary to wash the garment in order to remove the scent or lure. Furthermore, the scent or lure can be easily changed when it is desired to change the scent or lure. Various fringe elements such as 12, 13 may be provided, each with a different scent or lure.

The fringe 13 of FIGS. 1 to 5 is easily removable from one garment, or position on the garment, and applied to another garment, or to a different position on the garment.

I claim to have invented:

1. In combination:

a piece of clothing including camouflage means for providing camouflage for the wearer of the clothing, removable fringe which may be attached to, and detached from, said clothing, said fringe comprising a multiplicity of elongated elements held by said clothing with a first end of each element adjacent said clothing and the other end hanging vertically from said clothing, and supporting means for removable attachment to said clothing, said supporting means supporting said first-ends of said elements, wherein said supporting means is a sheet of material and said elements are positioned along at least one face of said sheet.

2. The combination of claim 1 in which at least one of, said supporting means or said elements, has means for producing a desired odor.

3. The combination of claim 1 in which said elements are positioned on both sides of said sheet.

4. In combination:

a piece of clothing including camouflage means for providing camouflage for the wearer of the clothing, removable fringe which may be attached to, and detached from, said clothing, said fringe comprising a multiplicity of elongated elements held by said clothing with a first end of each element adjacent said clothing and the other end hanging vertically from said clothing, and elastic bands for encircling clothing on a human arm for removably supporting said fringe so that said fringe hangs vertically below the arm.

5. A device for breaking up the outline of the human body, comprising:

fringe means comprising a multiplicity of fringe elements extending downwardly below a substantial part of the length of a human arm for breaking up the outline of the human body, each of said fringe elements having a first end with another end vertically below the first end, means for supporting said first ends adjacent to and below a human arm, a coat having two sleeves and a back side, said means for supporting said first ends including at least one ring around each of said sleeves, and means extending along the back side of the coat for holding said rings in place on said sleeves.

6. A device for breaking up the outline of the human body as defined in claim 5 in which said coat has a camouflage design on it.

7. Wearing apparel, comprising:

fringe means comprising a multiplicity of fringe elements each extending downwardly below a substantial part of the length of a human arm, each of said fringe elements having a first end with another end vertically below the first end, means for supporting said first ends adjacent to and below said human arm, and a coat having two sleeves, said means for supporting said first ends including at least one ring around each of said sleeves.

8. Wearing apparel as defined in claim 7, comprising:

means interconnecting said rings for holding them in place on said sleeves.

9. Apparatus for supporting fringe below a human arm, comprising:

at least two bands, which are separate from said arm and from any clothing on that arm, each of whose width is short compared to the length of a human arm, and each fitting around a human arm, fringe supporting means carried by said bands when they are positioned around the human arm, and elongated fringe elements having a first end carried by said fringe supporting means so that the elongated fringe elements will hang vertically below said arm, said bands being removable from said arm and from any clothing on said arm.

10. Apparatus as defined in claim 9 having means for holding said bands on said arm.

11. Apparatus as defined in claim 9 including a plurality of bands for another arm of said human being, and means for interconnecting at least one band on one arm with at least one band on the other arm, to hold those two bands in place.

* * * * *